US006554418B2

(12) United States Patent
Lawrence et al.

(10) Patent No.: US 6,554,418 B2
(45) Date of Patent: Apr. 29, 2003

(54) INK JET PRINTING METHOD

(75) Inventors: Kristine B. Lawrence, Rochester, NY (US); David M. Teegarden, Pittsford, NY (US); Tien-Teh Chen, Penfield, NY (US); Teh-Ming Kung, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 101 days.

(21) Appl. No.: 09/771,251

(22) Filed: Jan. 26, 2001

(65) Prior Publication Data

US 2002/0149662 A1 Oct. 17, 2002

(51) Int. Cl.[7] ..... B41J 2/01
(52) U.S. Cl. ..... 347/105; 428/195
(58) Field of Search ..... 428/195, 422, 428/500, 323; 347/105, 106

(56) References Cited

U.S. PATENT DOCUMENTS 4,554,181 A * 11/1985 Cousin et al. ..... 427/261
5,439,739 A * 8/1995 Furukawa et al. ..... 428/341

FOREIGN PATENT DOCUMENTS

EP 1 022 383 A1 7/2000

* cited by examiner

*Primary Examiner*—Bruce H. Hess
*Assistant Examiner*—Michael E. Grendzynski
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with ink-receptive elements comprising a support having thereon an image-receiving layer comprising a graft copolymer comprising a backbone copolymer and at least one branch copolymer, the backbone polymer comprising structural units capable of being oxidized by a transition metal catalyst and the branch copolymer comprising cationic units and neutral hydrophilic units;

C) loading the printer with an ink jet ink composition comprising water, a humectant, and a water-soluble anionic dye; and D) printing on the image-receiving layer using the ink jet ink in response to the digital data signals.

19 Claims, No Drawings

INK JET PRINTING METHOD

CROSS REFERENCE TO RELATED APPLICATIONS

Reference is made to commonly assigned, co-pending U.S. patent applications:

Ser. No. 09/770,814 by Bermel et al., filed of even date herewith entitled "Ink Jet Recording Element";

Ser. No. 09/771,191 by Bermel et al., filed of even date herewith entitled "Ink Jet Recording Element";

Ser. No. 09/770,429 by Bermel et al., filed of even date herewith entitled "Ink Jet Recording Element";

Ser. No. 09/770,682 by Bermel et al., filed of even date herewith entitled "Ink Jet Recording Element";

Ser. No. 09/771,189 by Bermel et al., filed of even date herewith entitled "Ink Jet Printing Method";

Ser. No. 09/770,433 by Bermel et al., filed of even date herewith entitled "Ink Jet Printing Method";

Ser. No. 09/770,807 by Bermel et al., filed of even date herewith entitled "Ink Jet Printing Method";

Ser. No. 09/770,728 by Berrnel et al., filed of even date herewith entitled "Ink Jet Printing Method";

Ser. No. 09/770,128 by Lawrence et al., filed of even date herewith entitled "Ink Jet Printing Method";

Ser. No. 09/770,127 by Lawrence et al., filed of even date herewith entitled "Ink Jet Printing Method";

Ser. No. 09/770,781 by Lawrence et al., filed of even date herewith entitled "Ink Jet Printing Method";

Ser. No. 09/770,122 by Lawrence et al., filed of even date herewith entitled "Ink Jet Printing Method";

Ser. No. 09/772,097 by Lawrence et al., filed of even date herewith entitled "Ink Jet Printing Method"; and Ser. No. 09/770,431 by Lawrence et al., filed of even date herewith entitled "Ink Jet Printing Method".

FIELD OF THE INVENTION

This invention relates to an inkjet printing process for improving the smear, light stability and density of a printed image containing an ink jet ink containing a water-soluble anionic dye and a cationic receiver.

BACKGROUND OF THE INVENTION

Ink jet printing is a non-impact method for producing images by the deposition of ink droplets in a pixel-by-pixel manner to an image-recording element in response to digital signals. There are various methods which may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to an ink sump. In another process, known as drop-on-demand inkjet, individual ink droplets are projected as needed onto the image-recording element to form the desired image. Common methods of controlling the projection of ink droplets in drop-on-demand printing include piezoelectric transducers and thermal bubble formation. Inkjet printers have found broad applications across markets ranging from industrial labeling to short run printing to desktop document and pictorial imaging.

The inks used in the various inkjet printers can be classified as either dye-based or pigment-based. A dye is a colorant which is molecularly dispersed or solvated by a carrier medium. The carrier medium can be a liquid or a solid at room temperature. A commonly used carrier medium is water or a mixture of water and organic co-solvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor light-fastness. When water is used as the carrier medium, such inks also generally suffer from poor water-fastness.

An inkjet recording element typically comprises a support having on at least one surface thereof an ink-receiving or image-forming layer. The ink-receiving layer may be a polymer layer which swells to absorb the ink or a porous layer which imbibes the ink via capillary action.

Ink jet prints, prepared by printing onto ink jet recording elements, are subject to environmental degradation. They are especially vulnerable to water smearing, dye bleeding, coalescence and light fade. For example, since ink jet dyes are water-soluble, they can migrate from their location in the image layer when water comes in contact with the receiver after imaging. Highly swellable hydrophilic layers can take an undesirably long time to dry, slowing printing speed, and will dissolve when left in contact with water, destroying printed images. Porous layers speed the absorption of the ink vehicle, but often suffer from insufficient gloss and severe light fade. There is a need to provide an ink jet recording element which overcomes the above deficiencies.

EP A 1 022 383 A1 discloses a treating agent for a sheet surface to be used in ink jet printing. The treating agent is described as being a graft copolymer composed of a backbone polymer and a branch polymer, either of which is a polymer having vinyl alcohol units, and the other of which is a polymer having cationic groups. However, there is a problem with this graft copolymer in that images printed on an image-receiving layer containing this graft copolymer have undesirable smearing when subjected to high humidity conditions.

It is an object of this invention to provide an ink jet printing method using anionic dyes suitable for use in aqueous inks for ink jet printing that will provide images with better smear, light stability and density using certain receiver elements.

SUMMARY OF THE INVENTION

This and other objects are achieved in accordance with this invention which relates to an inkjet printing method, comprising the steps of:

A) providing an ink jet printer that is responsive to digital data signals;

B) loading the printer with ink-receptive elements comprising a support having thereon an image-receiving layer comprising a graft copolymer comprising a backbone copolymer and at least one branch copolymer, the backbone copolymer comprising structural units capable of being oxidized by a transition metal catalyst and the branch copolymer comprising cationic units and neutral hydrophilic units;

C) loading the printer with an ink jet ink composition comprising water, a humectant, and a water-soluble anionic dye; and D) printing on the image-receiving layer using the ink jet ink in response to the digital data signals.

It has been found that use of the above dyes and image-receiving layer provides excellent smear, light stability and density.

DETAILED DESCRIPTION OF THE INVENTION

Any anionic, water-soluble dye may be used in a composition employed in the method of the invention such as a dye having an anionic group, e.g., a sulfo group or a carboxylic group. The anionic, water-soluble dye may be any acid dye, direct dye or reactive dye listed in the COLOR INDEX but is not limited thereto. Metallized and non-metallized azo dyes may also be used as disclosed in U.S. Pat. No. 5,482,545, the disclosure of which is incorporated herein by reference. Other dyes which may be used are found in EP 802246-A1 and JP 09/202043, the disclosures of which are incorporated herein by reference. In a preferred embodiment, the anionic, water-soluble dye which may be used in the composition employed in the method of the invention is a metallized azo dye, a non-metallized azo dye, a xanthene dye, a metallophthalocyanine dye or a sulfur dye. Mixtures of these dyes may also be used. An example of an anionic dye which may be used in the invention is as follows:

Dye 1

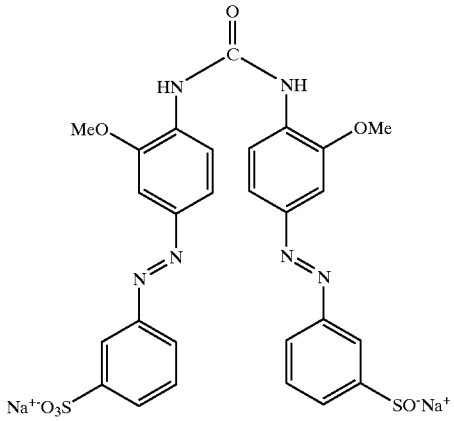

(Me is methyl)
Intrajet Yellow DG®
(Crompton and Knowles)

Dye 2

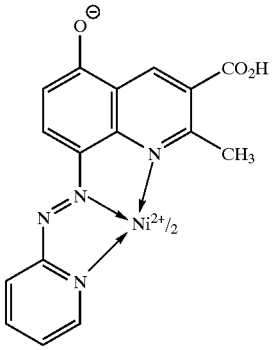

The dyes described above may be employed in any amount effective for the intended purpose. In general, good results have been obtained when the dye is present in an amount of from about 0.2 to about 5% by weight of the ink jet ink composition, preferably from about 0.3 to about 3% by weight. Dye mixtures may also be used.

As noted above, the graft copolymer useful in the invention comprises a graft copolymer comprising a backbone copolymer and at least one branch copolymer, the backbone polymer comprising structural units capable of being oxidized by a transition metal catalyst and the branch copolymer comprising cationic units and neutral hydrophilic units.

Examples of backbone polymers comprising structural units capable of being oxidized by a transition metal catalyst include substituted or unsubstituted vinyl polymers or cellulosics, preferably poly(vinyl alcohols), poly(N-vinylpyrrolidones), polyamides, or substituted celluloses such as alkyl celluloses, hydroxyalkyl celluloses, etc. The backbone polymer can be a homopolymer or a copolymer. On being oxidized, the backbone polymer presumably forms a free radical site on the backbone that can attack ethylenically unsaturated branching monomers, thus leading to the formation of a grafted copolymer. A preferred transition metal catalyst is a $Ce^{IV}$ salt. Particularly preferred backbone polymers useful in the invention are poly(vinyl alcohols), such as those having from about 60 mol % to about 100 mol % hydrolyzed.

The branch copolymer that is grafted onto the backbone polymer comprises both cationic units as well as neutral, hydrophilic units. Monomers used to introduce cationic units into the branch copolymer include those with the following general structure:

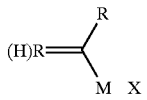

where R is each independently H or a substituted or unsubstituted alkyl group of 1 to about 4 carbon atoms, M is a group containing cationic charge, and X is an anion or a mixture of anions.

Preferred examples of M are:

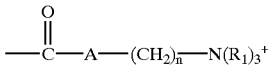

where A is either 0 or NH, each $R_1$, independently represents an alkyl, cyclic alkyl, or aryl group having from 1 to about 20 carbon atoms, and n is an integer from 2 to about 12.

Another preferred example of M is:

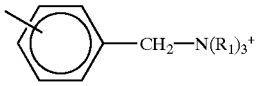

where $R_1$ is defined as above. In addition to the substituents indicated, the ring can also contain an alkyl group of from 1 to about 4 carbon atoms, a phenyl group, a benzyl group, or a second, fused ring.

Still another preferred example of M is:

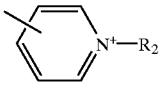

where $R_2$ represents H or an alkyl, cyclic alkyl, or alkoxy group having from 1 to about 20 carbon atoms. In addition to the substituents indicated, the ring can also contain an alkyl group of from 1 to about 4 carbon atoms, a phenyl group, a benzyl group, a halide group or a second, fused ring.

Still another preferred example of M is:

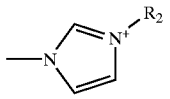

where $R_2$ represents H or an alkyl, cyclic alkyl, or alkoxy group having from 1 to about 20 carbon atoms. In addition to the substituents indicated, the ring can also contain an alkyl group of from 1 to about 4 carbon atoms, a phenyl group, a benzyl group, a halide group, or a second, fused ring.

X is an anion or a mixture of anions, such as halide (e.g., chloride or bromide), alkylsulfate (e.g. methylsulfate), alkylsulfonate (e.g. methylsulfonate), or arylsulfonate (e.g. benzenesulfonate or toluenesulfonate). Other anions can be used if desired. Preferred anions are chloride and methylsulfate.

Specific examples of monomers used to introduce cationic units into the branch copolymer include [(2-acryloyloxy) ethyl]trimethylammonium methylsulfate, [(2-methacryloyloxy) ethyl]trimethylammonium methylsulfate, [(2-methacryloyloxy) ethyl]trimethylammonium chloride, [(3-methacrylamido)-propyl ]trimethylammonium chloride, and [2-(acryloyloxy)ethyl](4-benzoylbenzyl) dimethylammonium bromide. Other examples include (vinylbenzyl) trimethylammonium chloride, (vinylbenzyl) dimethyldodecylammonium chloride, or (vinylbenzyl) dimethyloctadecylammonium chloride.

Monomers used to introduce the neutral, hydrophilic units into the branch copolymer include water-soluble or hydrophilic monomers such as acrylamides, methacrylamides, N-vinylpyrrolidone or suitably substituted vinylpyrrolidones, vinyl ethers, e.g., methyl vinyl ether, hydroxyalkyl esters of acrylates or methacrylates, e.g., 2-hydroxyelhyl methacrylate, and other monomers known to those familiar with the art. A preferred monomer is acrylamide.

Specific examples of the graft copolymers that are useful in the invention are listed below. In each case, the poly(vinyl alcohol) was 80% hydrolyzed and had a molecular weight in the range 8000–10,000. Each of the comonomers was grafted in the amount of 10 weight % compared to poly (vinyl alcohol), unless otherwise indicated.

P-1: Poly(vinyl alcohol)-graft-poly(acrylaniide-co-[(2-methacryloyloxy) ethyl]trimethylammonium methylsulfate)

P-2: Poly(vinyl alcohol)-graft-poly(acrylanlide-co-[(2-methacryloyloxy) ethyl]trimethylamrnonium methylsulfate) [20 wt %/20 wt %]

P-3: Poly(vinyl alcohol)-graft-poly(acrylamide-co-[ar-vomu;bemzyl]trimethylammonium chloride)

P-4: Poly(vinyl alcohol)-graft-poly(acrylarrLide-co-[ar-vinylbenzyl]trimethylammonium chloride) [20 wt %/20 wt %]

P-5: Poly(vinyl alcohol)-graft-poly(acrylanide-co-[(2-methacryloyloxy) ethyl]trimethylamrnonium chloride)

P-6: Poly(vinyl alcohol)-graft-poly(acrylamide-co-[(2-methacryloyloxy) ethyl]trimethylamrnonium methylsulfate)

P-7: Poly(vinyl alcohol)-graft-poly(acrylamide-co-[ar-vinylbenzyl]trimethylammonium chloride)

P-8: Poly(vinyl alcohol)-graft-poly(acrylamide-co-[(3-methacrylamido) propyl]trimethylammonium chloride)

P-9: Poly(vinyl alcohol)-graft-poly(acrylairlide-co-[2-(acryloyloxy)ethyl](4-benzoylbenxyl) dimethylammonium bromide)

P-10: Poly(vinyl alcohol)-graft-poly(acrylamide-co-[ar-vinylbenzyl]dimethyloctadecylammonium chloride)

P-11: Poly(vinyl alcohol)-graft-poly(poly[ethylene glycol] methacrylate-co-[(2-methacryloyloxy) ethyl] trimethylamrnonium methylsulfate)

P-12: Poly(vinyl alcohol)-graft-poly(2-[melhacryloyloxy] ethyl phthalate-co-[(2-methacryloyloxy) ethyl] trimethylamrnonium methylsulfate)

P-13: Poly(vinyl alcohol)-graft-poly[(2-melhacryloyloxy) ethyl]diethylamine-co-[(2-methacryloyloxy) ethyl] trimethylammonium methylsulfate)

P-14: Poly(vinyl alcohol)-graft-poly(acrylanide-co-[(2-methacryloyloxy) ethyl]trimethylamrnonium chloride)

P-15: Poly(vinyl alcohol)-graft-poly(acrylanide-co-[(2-acryloyloxy) ethyl]trimethylammonium methylsulfate)

P-16: Poly(vinyl alcohol)-graft-poly(acrylamnide-co-[(2-acryloyloxy) ethyl]trimethylammonium methylsulfate)

P-17: Poly(vinyl alcohol)-graft-poly(poly[ethylene glycol] methacrylate-co-[(2-methacryloyloxy) ethyl] trimethylamrnonium methylsulfate)

In a preferred embodiment, the weight ratio of cationic to neutral hydrophilic monomer is from about 5:1 to about 1:5, preferably from about 2:1 to about 1:2.

In another preferred embodiment, the weight ratio of the backbone copolymer to the grafted copolymer is from about 20:1 to about 1:5, preferably from about 10:1 to about 1:2.

In another preferred embodiment of the invention, the graft copolymer is present in the image-receiving layer can be used in an amount of from 0.2 to about 40 $g/m^2$, preferably from about 0.5 to about 21.5 $g/m^2$.

The graft copolymers used in this invention can be prepared using conventional polymerization techniques including solution polymerization, inverse emulsion polymerization, inverse suspension polymerization, or other techniques known to those familiar with the art. Particularly convenient is aqueous solution polymerization. A No. of compounds can be used to initiate the graft copolymerization, including azo initiators such as 4,4'-azobis(4-cyanovaleric acid) and its salts, 2,2'-azobis(2-methylpropionamidine) dihydrochloride, and so forth. Other initiators include oxidizing compounds such as persulfate salts, possibly in combination with sulfite salts, or transition metal ions. Particularly useful as initiator is ceric ammonium sulfate.

A binder may also be added to the image-receiving layer employed in the invention, such as poly(vinyl alcohol), poly(l-vinyl pyrrolidone), poly(ethyl oxazoline), non-deionized or deicnized Type IV bone gelatin, acid processed ossein gelatin, pig skin gelatin, acetylated gelatin, phthalated gelatin, oxidized gelatin, chitosan, poly(alkylene oxide), sulfonated polyester, partially hydrolyzed poly(vinyl acetate-co-vinyl alcohol), poly(acrylic acid), poly(1-vinylpyrrolidone), poly(sodium styrene sulfonate), poly(2-acrylamido-2-methane sulfonic acid), polyacrylamide or mixtures thereof In a preferred embodiment of the invention, the binder is gelatin or poly(vinyl alcohol). If a binder is used, then the amount can be up to about 50 wt. % of the image-receiving layer.

Latex polymer particles and/or inorganic oxide particles may also be used as the binder in the image-receiving layer to increase the porosity of the layer and improve the dry time. Preferably the latex polymer particles and/or inorganic oxide particles are cationic or neutral. Examples of inorganic oxide particles include barium sulfate, calcium carbonate, clay, silica or alumina, or mixtures thereof.

Particulates may also be used in the image-receiving layer. In that case, the weight % of particulates in the image-receiving layer is from about 80 to about 95%, preferably from about 85 to about 90%.

The pH of the aqueous ink compositions employed in the invention may be adjusted by the addition of organic or inorganic acids or bases. Useful inks may have a preferred pH of from about 2 to 10, depending upon the type of dye being used. Typical inorganic acids include hydrochloric, phosphoric and sulfuric acids. Typical organic acids include, methanesulfonic, acetic and lactic acids. Typical inorganic bases include alkali metal hydroxides and carbonates. Typical organic bases include ammonia, triethanolamine and tetramethylethlenediamine.

A humectant is employed in the ink jet composition employed in the invention to help prevent the ink from drying out or crusting in the orifices of the printhead. Examples of humectants which can be used include polyhydric alcohols, such as ethylene glycol, diethylene glycol, triethylene glycol, propylene glycol, tetraethylene glycol, polyethylene glycol, glycerol, 2-methyl-2,4-pentanediol, 1,2,6-hexanetriol and thioglycol; lower alkyl mono-or di-ethers derived from alkylene glycols, such as ethylene glycol mono-methyl or mono-ethyl ether, diethylene glycol mono-methyl or mono-ethyl ether, propylene glycol mono-methyl or mono-ethyl ether, triethylene glycol mono-methyl or mono-ethyl ether, diethylene glycol di-methyl or di-ethyl ether, and diethylene glycol monobutylether; nitrogen-containing cyclic compounds, such as pyrrolidone, N-methyl-2-pyrrolidone, and 1,3-dimethyl-2-irridazolidinone; and sulfur-containing compounds such as dimethyl sulfoxide and tetramethylene sulfone. A preferred humectant for the composition employed in the invention is diethylene glycol, glycerol, or diethylene glycol monobutylether.

Water-miscible organic solvents may also be added to the aqueous ink employed in the invention to help the ink penetrate the receiving substrate, especially when the substrate is a highly sized paper. Examples of such solvents include alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; ketones or ketoalcohols such as acetone, methyl ethyl ketone and diacetone alcohol; ethers, such as tetrahydrofuran and dioxane; and esters, such as, ethyl lactate, ethylene carbonate and propylene carbonate.

Surfactants may be added to adjust the surface tension of the ink to an appropriate level. The surfactants may be anionic, cationic, amphoteric or nonionic.

A biocide may be added to the composition employed in the invention to suppress the growth of microorganisms such as molds, fungi, etc. in aqueous inks. A preferred biocide for the ink composition employed in the present invention is Proxel® GXL (Zeneca Specialties Co.) at a final concentration of 0.0001–0.5 wt. %.

A typical ink composition employed in the invention may comprise, for example, the following substituents by weight: colorant (0.05–5%), water (20–95%), a humectant (5–70%), water miscible co-solvents (2–20%), surfactant (0.1–10%), biocide (0.05–5%) and pH control agents (0.1–10%).

Additional additives which may optionally be present in the inkjet ink composition employed in the invention include thickeners, conductivity enhancing agents, anti-kogation agents, drying agents, and defoamers.

The ink jet inks employed in this invention may be employed in ink jet printing wherein liquid ink drops are applied in a controlled fashion to an ink receptive layer substrate, by ejecting ink droplets from a plurality of nozzles or orifices of the print head of an ink jet printer.

The image-recording layer used in the process of the present invention can also contain various known additives, including matting agents such as titanium dioxide, zinc oxide, silica and polymeric beads such as crosslinked poly (methyl methacrylate) or polystyrene beads for the purposes of contributing to the non-blocking characteristics and to control the smudge resistance thereof, surfactants such as non-ionic, hydrocarbon or fluorocarbon surfactants or cationic surfactants, such as quaternary ammonium salts; fluorescent dyes; anti controllers; anti-foaming agents; lubricants; preservatives; viscosity modifiers; dye-fixing agents; waterproofing agents; dispersing agents; UV absorbing agents; mildew-proofing agents; antistatic agents, antioxidants, optical brighteners, and the like. A hardener may also be added to the ink-receiving layer if desired.

The support for the ink jet recording element used in the invention can be any of those usually used for ink jet receivers, such as paper, resin-coated paper, polyesters, or microporo us materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxally oriented support laminates. Biaxally oriented support laminates are described in U.S. Pat. Nos. 5,853,965; 5,866,282; 5,874,205; 5,888,643; 5,888,681; 5,888,683, and 5,888,714, the disclosures of which are hereby incorporated by reference. These biaxally oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint.

The support used in the invention may have a thickness of from about 50 to about 500 $\mu$m, preferably from about 75 to 300 $\mu$m. Antioxidants, antistatic agents, plasticizers and other known additives may be incorporated into the support, if desired. In a preferred embodiment, paper is employed.

In order to improve the adhesion of the image-recording layer to the support, the surface of the support may be subjected to a corona-discharge-treatment prior to applying the image-recording layer.

In addition, a subbing layer, such as a layer formed from a halogenated phenol or a partially hydrolyzed vinyl chloride-vinyl acetate copolymer can be applied to the surface of the support to increase adhesion of the image recording layer. If a subbing layer is used, it should have a thickness (i.e., a dry coat thickness) of less than about 2 $\mu$m.

The image-recording layer may be present in any amount which is effective for the intended purpose. In general, good results are obtained when it is present in an amount of from about 2 to about 44 g/m$^2$, preferably from about 6 to about 32 g/m$^2$, which corresponds to a dry thickness of about 2 to about 40 $\mu$m, preferably about 6 to about 30 $\mu$m.

The following examples illustrate the utility of the present invention.

EXAMPLES

The following copolymers were used as controls in the image-receiving layer:

CP-1: Poly(acrylamide-co-[(2-methacryloxy)ethyl] trimethylammonium methylsulfate) (1/1 wt)

CP-2: Poly(acrylamide-co-[ar-vinylbenzyl] trimethylammonium chloride) (1/1 wt)

CP-3: Poly(acrylamide-co-[(2-methacryloyl oxy)ethyl] trimethylammonium chloride) (1/1 wt)

CP-4: Poly(acrylamide-co-[(3-methacrylamnido)propyl] trimethylammonium chloride) (1/1 wt)

CP-5: Poly(acrylamide-co-[2-(acryloyloxy)ethyl](4-benzoylbenzyl) dimethylammonium bromide) (1/1 wt)

CP-6: Poly(vinyl alcohol)-graft-poly([(2-methacryloyloxy) ethyl]-trimethylammonium methylsulfate) (10 wt % grafted monomer compared to poly(vinyl alcohol)) (EP A 1 022 383 A1)

CP-7: Poly(acrylamide-co-[(2-acryloyloxy)ethyl] trimethylammonium methylsulfate) (1/1 wt)

CP-8: Poly(poly[ethylene glycol] methacrylate-co-[(2-methacryloyloxy) ethyl] trimethylamrnonium methylsulfate) (1/1 wt)

Example 1

Synthesis of a Grafted PVA Copolymer

Poly(vinyl alcohol)-graft-poly(acrylamide-co-[(2-methacryloyloxy)ethyl]-trimethylammonium chloride) (P-5)

A 1-L3-necked round-bottomed flask fitted with a mechanical stirrer, reflux condenser, and $N_2$ inlet was charged with 400 g of deionized water, sparged with $N_2$ for 30 min, and heated to 60° C. Poly(vinyl alcohol) (100 g; 80% hydrolyzed; MW 9000–10,000; Aldrich Chemical Company) was added slowly with stirring. Heating and stirring were continued until the polymer had dissolved, and then the solution was cooled Lo 30° C.

A solution of 10 g of acrylarrtide (Aldrich Chemical Company) and 13.3 g of [(2-methacryloyloxy)ethyl] trirnethylammonium chloride (Aldrich Chemical Company; 75% pure) in 40 g of deionized water, previously sparged with $N_2$, was added to the PVA solution above followed by 16 g of a 0.1 M ceric ammonium nitrate solution in IM nitric acid. The solution turned deep yellow, but the color faded with time. The reaction mixture was stirred at 30° C. for 2 hr, cooled, and then precipitated into a 20-fold (excess of acetone with rapid stirring. The precipitate was collected on a filter, washed with fresh acetone, and dried under vacuum.

Example 2

Smearing of Grafted vs. Ungrafted Addition Polymers

Preparation of a Water Soluble, Anionic Dye Ink Composition, I-1

Ink I-1 containing Dye 2 was prepared by mixing the dye concentrate (0.58%) with de-ionized water containing humectants of diethylene glycol (Aldrich Chemical Co.) and glycerol (Acros Co.), each at 6%, a biocide, Proxel GXL® biocide (Zeneca Specialties) at 0.003 wt %, and a surfactant, Surfynol 465® (Air Products Co.) at 0.05 wt. %.

The dye concentration was based on solution absorption spectra and chosen such that the final ink when diluted 1:1000, would yield a transmission optical density of approximately 1.0.

Preparation of Control Ink Recording Elements C-1 through C-5

The composite side of a polyethylene resin coated photographic grade paper based support was corona discharge treated prior to coating. Ink receptive layers were composed of mixtures of Mowiol 480® poly(vinyl alcohol) (Hoechst-Celanese Co.), CP-1 or CP-2 and 0.09 g/m$^2$ of S-100 20 $\mu$m polystyrene beads (ACE Chemical Co.), coated from distilled water on the above mentioned paper support. The amounts of Mowiol 480®, CP-1 or CP-2 used are shown in Table 1 below.

TABLE 1

| Receiver Element | Control Polymer (g/m$^2$) | PVA (g/m$^2$) |
|---|---|---|
| C-1 | CP-1 (1.45) | 7.15 |
| C-2 | CP-1 (2.48) | 6.13 |
| C-3 | CP-2 (1.45) | 7.15 |
| C-4 | CP-2 (2.48) | 6.13 |
| C-5 | — | 8.61 |

Preparation of Invention Ink Recording Elements E-1 through E-4

Recording elements E-1 through E-4 of the invention were coated the same as described for control receiver elements C-1 through C-5 except the ink receptive layers were composed of 8.61 g/m$^2$ of P-1 through P-4 and 0.09 g/m$^2$ of S-100 20 $\mu$m polystyrene beads only.

Printing

The recording elements E-1 through E-4 of the invention and control recording elements C-1 through C-5 were printed using an Epson 200® printer using I-1 ink described above. After printing, all images were allowed to dry at room temperature overnight and the dot size in the lowest density step (Step 1) was measured using an BH-2 Olympus Microscope (10×objective) and recorded. The images were then subjected t) a smearing test by placing the images in an environmental chamber (Lunaire Corporation) at 38° C. and 80% rh for 1 week. The dot size at step 1 was remeasured as described above and a % change in dot size was calculated for each receiver element. The results can be found in Table 2 below.

TABLE 2

| Recording Element | Dot size before smear ($\mu$m) | Dot size after smear ($\mu$m) | Change in dot size (%) |
|---|---|---|---|
| E-1 | 150 | 205 | 37 |
| E-2 | 155 | 195 | 26 |
| E-3 | 158 | 180 | 14 |
| E-4 | 170 | 205 | 21 |
| C-1 | 165 | 325 | 97 |
| C-2 | 163 | 325 | 99 |
| C-3 | 175 | 275 | 57 |
| C-4 | 170 | 240 | 41 |
| C-5 | 280 | 440 | 57 |

The above results show that the recording elements of the invention gave lower % change after smearing as compared to the control recording elements.

Example 3

Smearing of Grafted vs. Ungrafted Polymers-Different PVA

Preparation of Control Ink Recording Element C-6

Control recording element C-6 was composed of 8.61 g/m$^2$ of poly(vinyl alcohol) (80% hydrolyzed; 9–10K MW;

Aldrich Chemical Company) and 0.09 g/m$^2$ of S-100 12 $\mu$m poly(styrene) beads (ACE Chemical Co.), coated from distilled water on the paper support described in Example 2 above.

Preparation of Control Ink Recording Elements C-7 through C-11

Control recording elements C-7 through C-11 were composed of a mixture of 1.45 g/m$^2$ of CP-1 through CP-5, 7.15 g/m$^2$ of poly(vinyl alcohol) (80% hydrolyzed; 9–10K MW; Aldrich Chemical Company) and 0.09 g/m$^2$ of S-100 12 $\mu$m polystyrene beads (ACE Chemical Co.), coated from distilled water on the paper support described in Example 2 above.

Preparation of Control Ink Recording Element C-12

Control recording elements C-12 was coated the same as C-6 above, except the poly(vinyl alcohol) (80% hydrolyzed; 9–10K MW; Aldrich Chemical Company) was replaced with CP-6.

Preparation of Invention Ink Recording Elements E-5 through E-13

Recording elements E-5 through E-13 of the invention were coated the same as C-6 above, except the poly(vinyl alcohol) (80% hydrolyzed; 9–10K MW; Aldrich Chemical Company) was repliced with P-5 through P-13 of the invention Printing Elements E-5 through E-13 and control elements C-6 through C-12 were printed and evaluated as described in Example 2 above and the results can be found in Table 3 below.

TABLE 3

| Recording Element | Polymer | Dot size before smear (mm) | Dot size after smear (mm) | Change in dot size (%) |
|---|---|---|---|---|
| E-5 | P-5 | 15 | 17 | 13 |
| E-6 | P-6 | 15.5 | 21 | 35 |
| E-7 | P-7 | 14.5 | 20 | 38 |
| E-8 | P-8 | 15.5 | 20.5 | 32 |
| E-9 | P-9 | 14.5 | 17 | 17 |
| E-10 | P-10 | 15.5 | 16.5 | 6 |
| E-11 | P-11 | 17.5 | 15 | −14 |
| E-12 | P-12 | 16 | 20.5 | 28 |
| E-13 | P-13 | 14 | 19.5 | 39 |
| C-6 | — | 15.5 | 22.5 | 45 |
| C-7 | CP-1 | 13.5 | 31 | 130 |
| C-8 | CP-2 | 14 | 23.5 | 68 |
| C-9 | CP-3 | 14 | 32 | 129 |
| C-10 | CP-4 | 14 | 24 | 71 |
| C-11 | CP-5 | 13.5 | 24 | 78 |
| C-12 | CP-6 | 17.5 | 31.5 | 80 |

The above results show that the recording elements of the invention gave lower % change after smearing as compared to the control recording elements.

Example 4

Light Stability Using Particulales

Preparation of Invention Control Ink Recording Elements C-13 and C-14

Control recording elements C-13 and C-14 were prepared as in Example 3 except the ink receptive layer was composed of two layers. The bottom layer was composed of a mixture of 37.9 g/m$^2$ of fumed alumina (Cabot Corp.), 4.3 g/m$^2$ of GH-23® poly(vinyl alcohol) (Nippon Gohsei); 0.9 g/m$^2$ of dihydroxydioxane (Clariant) hardener, and 0.04 g.m$^2$ of Olin 10G ® (Olin Co.) surfactant coated from distilled water.

On top of the above layer was then coated a mixture of 2.68 g/m$^2$ of fumed alumina, 0.06 g/m$^2$ of GH-23 poly(vinyl alcohol), and 0.48 g/m$^2$ of CP-7 or CP-8 coated from distilled water.

Preparation of Invention Ink Recording Elements E-14 through E-20

Recording elements E-14 through E-20 of the invention were prepared as control recording elements above except the top layer was a mixture of 2.68/m$^2$ of fumed alumina and 0.55/m$^2$ of P-5, P-10, P-12, or P-14 through P-17 using distilled water.

Printing

The recording elements E-14 through E-20 of the invention and control recording elements C-13 and C-14 were printed using the Epson 900® printer with corresponding Epson inks (color cartridge #T005 and black cartridge #T003). After printing, all images were allowed to dry at room temperature overnight and the densities were measured at all steps using an X-Rite 820® densitometer. The images were then subjected to a high intensity daylight fading test for 2 weeks, 50Klux, 5400° K., approximately 25% rh. The Status A blue, green or red reflection densities at 50% coverage were compared before and after fade and a percent density retained was calculated for the yellow, magenta and cyan dyes with each receiver element. The results can be found in Table 4 below.

TABLE 4

| Recording Element | Polymer | % Retained Yellow | % Retained Magenta | % Retained Cyan |
|---|---|---|---|---|
| E-14 | P-5 | 56 | 34 | 87 |
| E-15 | P-10 | 66 | 39 | 84 |
| E-16 | P-12 | 67 | 41 | 84 |
| E-17 | P-14 | 62 | 38 | 86 |
| E-18 | P-15 | 65 | 37 | 84 |
| E-19 | P-16 | 55 | 35 | 89 |
| E-20 | P-17 | 60 | 40 | 84 |
| C-13 | CP-7 | 53 | 31 | 86 |
| C-14 | CP-8 | 53 | 32 | 84 |

The above results show that the recording elements E-14 through E-20 of the invention gave better % retained, density after high intensity daylight fading than control recording elements C-13 and C-14 for the yellow and magenta dyes.

Example 5

Density Using Particulates

Preparation of Control Ink Recording Element C-15

Control recording element C-15 was prepared the same as C-13 and C-14 in Example 4 above except the top layer contained a mixture of 2.90 g/m$^2$ of fumed alumina and 0.32 g/m$^2$ of GH-23 poly(vinyl alcohol).

Printing

The recording elements E-14 through E-20 of the invention and control recording element C-15 were printed as described above in Example 4. After printing, all images were allowed to dry at room temperature overnight and the densities at 100% coverage (Dmax) were measured for the yellow, magenta and cyan dyes using an X-Rite 820® densitometer. The results can be found in Table 5 below.

TABLE 5

| Recording Element | Polymer | Dmax Density Yellow | Dmax Density Magenta | Dmax Density Cyan |
|---|---|---|---|---|
| E-14 | P-5 | 1.36 | 1.39 | 1.64 |
| E-15 | P-10 | 1.29 | 1.38 | 1.57 |
| E-16 | P-12 | 1.28 | 1.34 | 1.51 |
| E-17 | P-14 | 1.29 | 1.28 | 1.58 |

TABLE 5-continued

| Recording Element | Polymer | Dmax Density Yellow | Dmax Density Magenta | Dmax Density Cyan |
|---|---|---|---|---|
| E-18 | P-15 | 1.33 | 1.37 | 1.62 |
| E-19 | P-16 | 1.35 | 1.33 | 1.34 |
| E-20 | P-17 | 1.33 | 1.40 | 1.64 |
| C-15 | none | 1.23 | 1.31 | 1.53 |

The above results show that the recording element E-14 through E-20 of the invention, as compared to the control recording element C-15, gave higher densities at 100% coverage (Dmax).

The invention has been described in detail with particular reference to certain preferred embodiments thereof, but it will be understood that variations and modifications can be effected within the spirit and scope of the invention.

What is claimed is:

1. An ink jet printing method, comprising the steps of:

A) providing an ink jet printer that is responsive to digital data signals;

B) loading said printer with ink-receptive elements comprising a support having thereon an image-receiving layer comprising a graft copolymer comprising a backbone polymer and at least one branch copolymer, said backbone polymer comprising structural units capable of being oxidized by a transition metal catalyst and said branch copolymer comprising cationic units and neutral hydrophilic units;

C) loading said printer with an ink jet ink composition comprising water, a humectant, and a water-soluble anionic dye; and D) printing on said image-receiving layer using said ink jet ink in response to said digital data signals;

and said backbone polymer comprising structural units capable of being oxidized by a transition metal catalyst being poly(vinyl alcohol).

2. The method of claim 1 wherein monomers forming said cationic units of said branch copolymer have the formula:

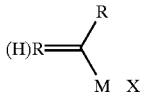

where R is each independently H or an alkyl group of from about 1 to about 4 carbon atoms, M is a group containing cationic charge, and X is an anion or a mixture of anions.

3. The method of claim 2 wherein said M is:

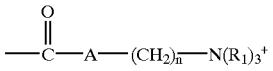

where A is either 0 or NH, each $R_1$, independently represents an alkyl, cyclic alkyl, or aryl group having from 1 to about 20 carbon atoms, and n is an integer from 2 to about 12.

4. The method of claim 2 wherein said monomer forming said cationic units is [(2-acryloyloxy)ethyl] trimelhylammonium methylsulfate, [(2-methacryloyloxy) ethyl]trimethylammonium methylsulfate, [(2-methacryloyloxy)ethyl]trimethylammonium chloride, [(3-methacrylamido)propyl]-trimethylammonium chloride, or [2-(acryloyloxy)ethyl](4-benzoylbenzyl)-dimethylammonium bromide.

5. The method of claim 2 wherein said M is:

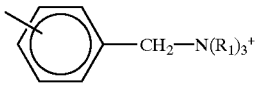

where $R_1$ is defined as above.

6. The method of claim 2 wherein said monomer forming said cationic units is (vinylbenzyl)trimethylammonium chloride, (vinylbenzyl)-dimethylodecylammonium chloride, or (vinylbenzyl)dimethyl-octadecylammonium chloride.

7. The method of claim 2 wherein said M is:

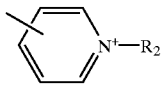

where $R_2$ represents H or an alkyl, cyclic alkyl, or alkoxy group having from 1 to about 20 carbon atoms.

8. The method of claim 2 wherein said M is:

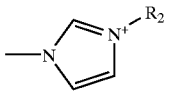

where $R_2$ represents H or an alkyl, cyclic alkyl, or alkoxy group having from 1 to about 20 carbon atoms.

9. The method of claim 2 wherein said X is chloride or methylsulfate.

10. The method of claim 1 wherein said neutral hydrophilic unit of said branch copolymer is acrylamide, methacrylamide, N-vinylpyrrolidone, methyl vinyl ether, 2-hydroxyethyl acrylate, 2-hydroxyethyl methacrylate, poly (ethylene glycol) methacrylate, or 2-(methacryloyloxy)ethyl phthalate.

11. The method of claim 1 wherein the weight ratio of said backbone copolymer to the grafted copolymer is from about 20:1 to about 1:5.

12. The method of claim 1 wherein the weight ratio of said cationic to said neutral hydrophilic monomer is from about 5:1 to about 1:5.

13. The method of claim 1 wherein said graft copolymer is present in said image-receiving layer in an amount of from 0.2 to about 40 g/m$^2$.

14. The method of claim 1 wherein said image-receiving layer also contains a binder.

15. The method of claim 14 wherein said binder is a hydrophilic polymer.

16. The method of claim 15 wherein said hydrophilic polymer is gelatin or poly(vinyl alcohol).

17. The method of claim 14 wherein said binder contains particulates.

18. The method of claim 17 wherein said particulate is an inorganic oxide, an organic latex polymer, barium sulfate, calcium carbonate, clay, silica or alumina.

19. The method of claim 1 wherein said anionic dye comprises about 0.2 to about 5% by weight of said ink jet ink composition.

* * * * *